United States Patent [19]

Agbay et al.

[11] Patent Number: 4,482,068

[45] Date of Patent: Nov. 13, 1984

[54] CHILD RESISTANT SAFETY CAP

[75] Inventors: Albert J. Agbay, Worcester, Mass.; Ralph H. Thomas, Sr., Clark, N.J.

[73] Assignee: Robert Linkletter Associates, Inc., Westboro, Mass.

[21] Appl. No.: 547,107

[22] Filed: Oct. 31, 1983

[51] Int. Cl.[3] ..... B65D 55/02

[52] U.S. Cl. ..... 215/225; 215/206; 116/308; 116/309; 116/317

[58] Field of Search ..... 215/206, 218, 221, 225; 206/534; 116/308, 309, 317

[56] References Cited

U.S. PATENT DOCUMENTS

| | | | |
|---|---|---|---|
| 3,830,394 | 8/1974 | Gestaevel | 215/225 |
| 3,863,797 | 2/1975 | Berghahn | 215/225 |
| 3,901,400 | 8/1975 | Westfall | 215/221 |
| 4,238,033 | 12/1980 | Artzt | 206/534 |

*Primary Examiner*—George T. Hall

*Attorney, Agent, or Firm*—Blakely, Sokoloff, Taylor & Zafman

[57] ABSTRACT

An improved safety closure for containers is disclosed; the closure comprises a snap-on cap held in place on a container by a rotary safety ring which must be aligned with the cap in one angular position and pushed downwardly away from the cap before one can remove the cap from the container. The closure is improved by providing an outwardly directed bead on the safety ring which makes it easier to grip and push down (and up) the safety ring. An annular protrusion, added to the underside of the cap, and a circumferential knob, added to the neck of the container, improve the seal of the container. Also, a safety ring and cap assembly which has no lateral opening between the safety ring and the cap is disclosed. This invention describes various ways to incorporate on the closure means for counting the number of uses or doses of the container's contents. Finally, two specific embodiments of the closure, a closure for a powder container and a pipette dropper safety closure, are described with some of the improvements.

40 Claims, 22 Drawing Figures

Fig. 7
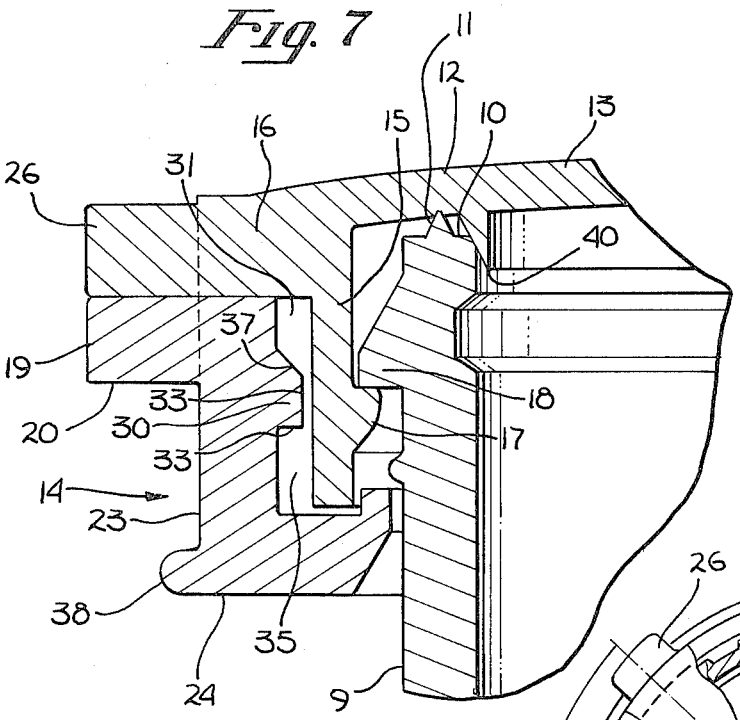
Fig. 8
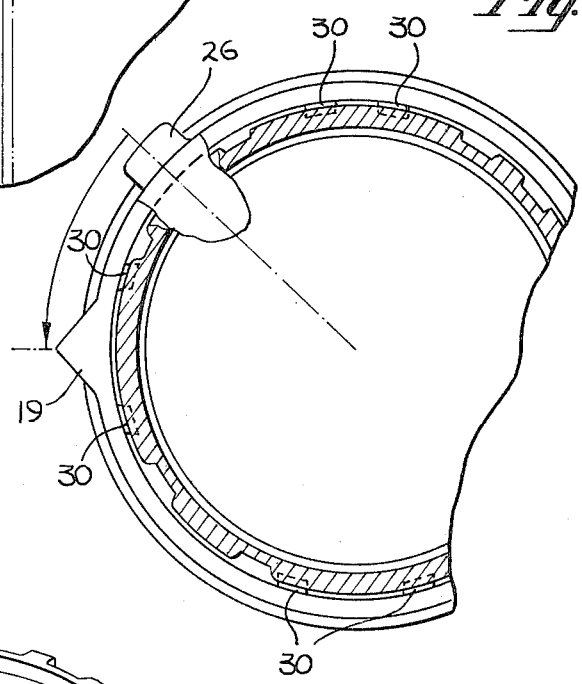
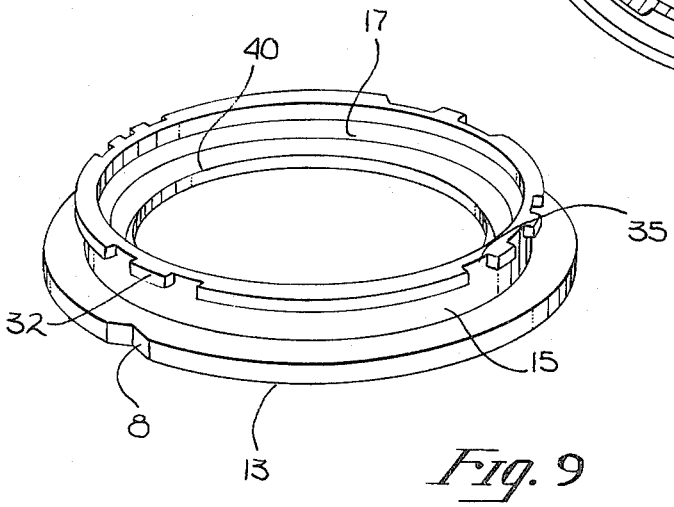
Fig. 9

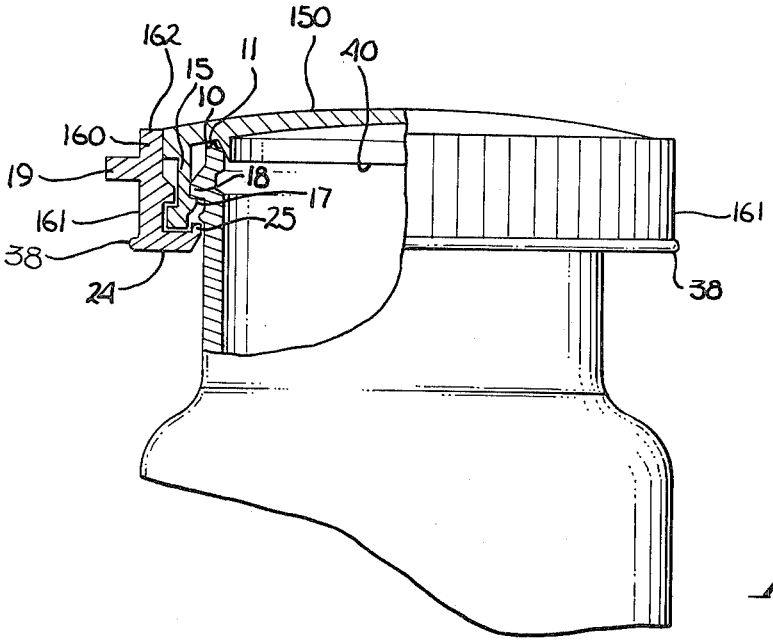
Fig. 22
Fig. 12
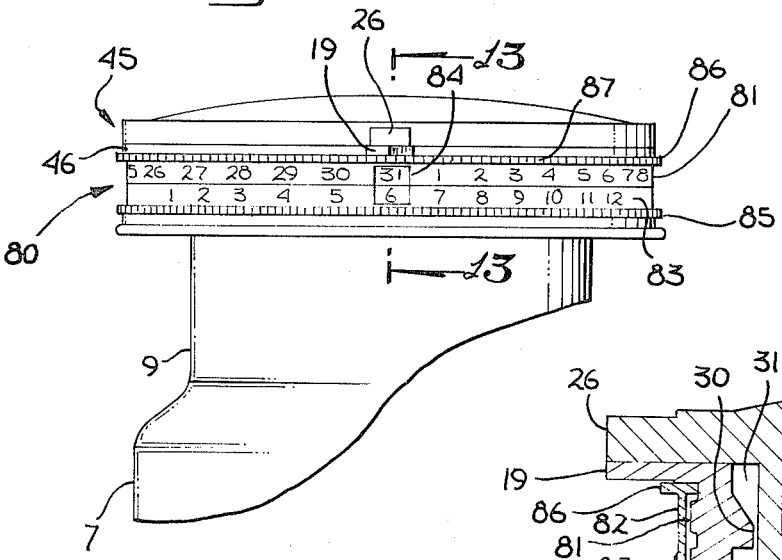
Fig. 13
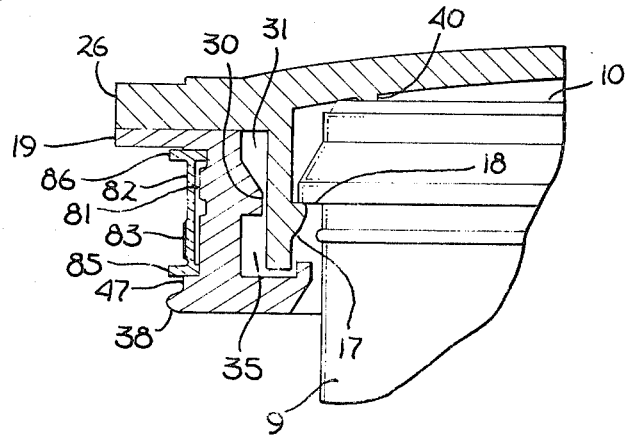

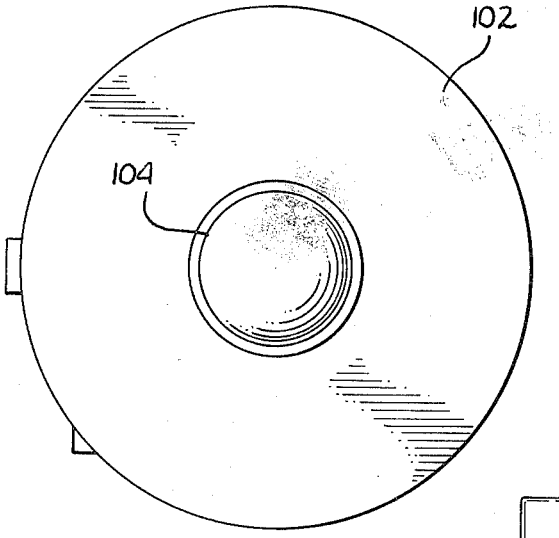
Fig. 14
Fig. 15
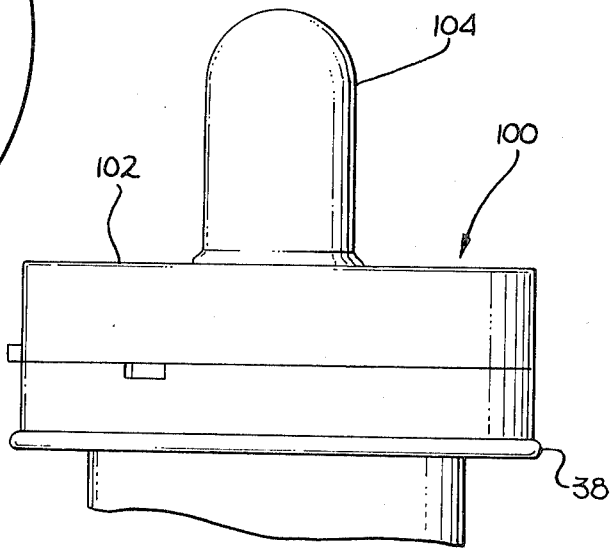
Fig. 16
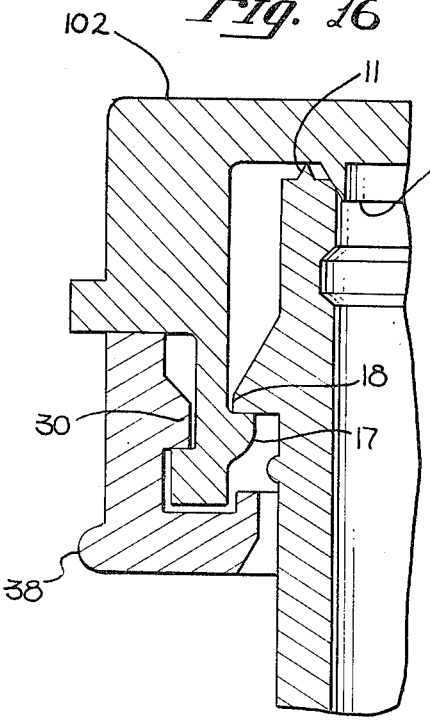
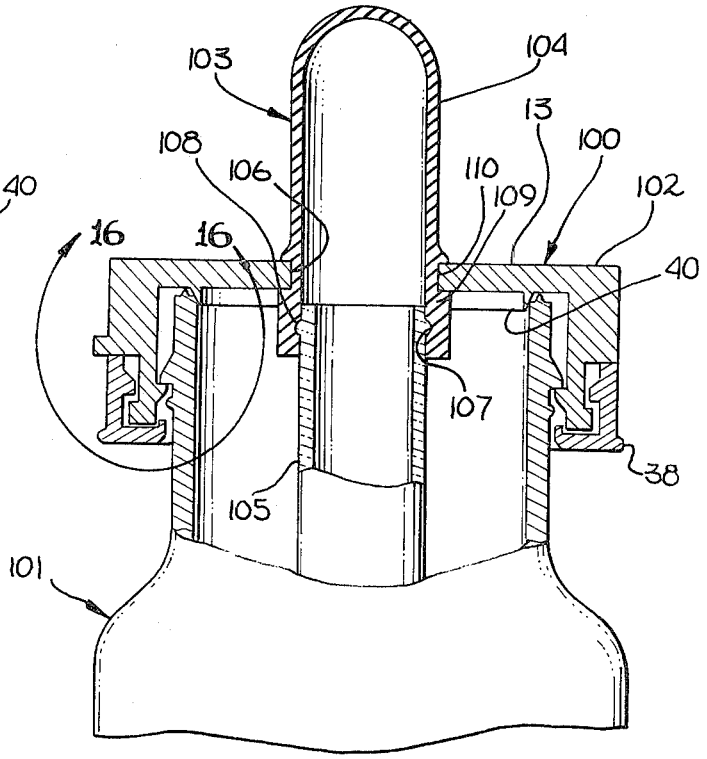
Fig. 17

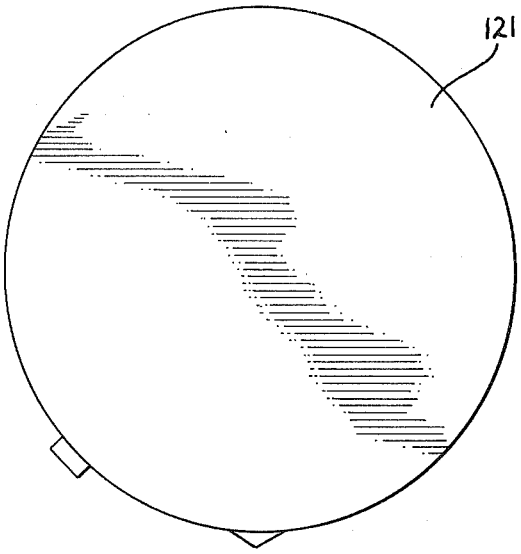
Fig. 18
Fig. 19
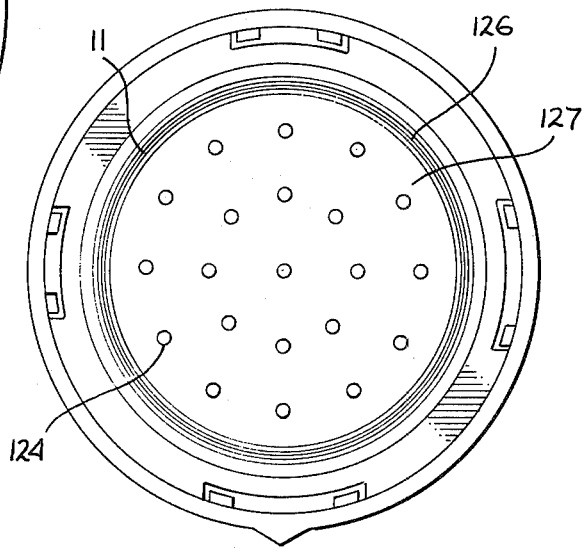
Fig. 20
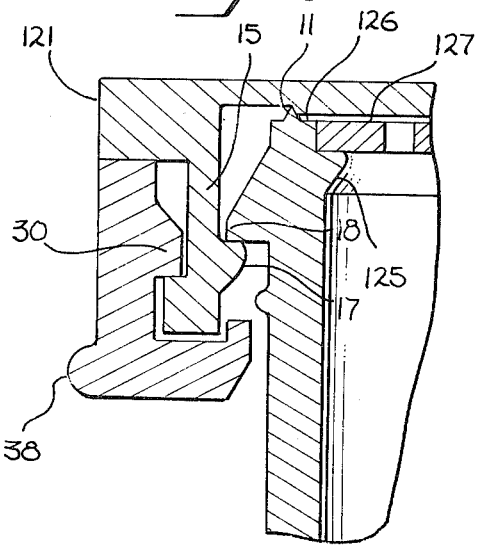
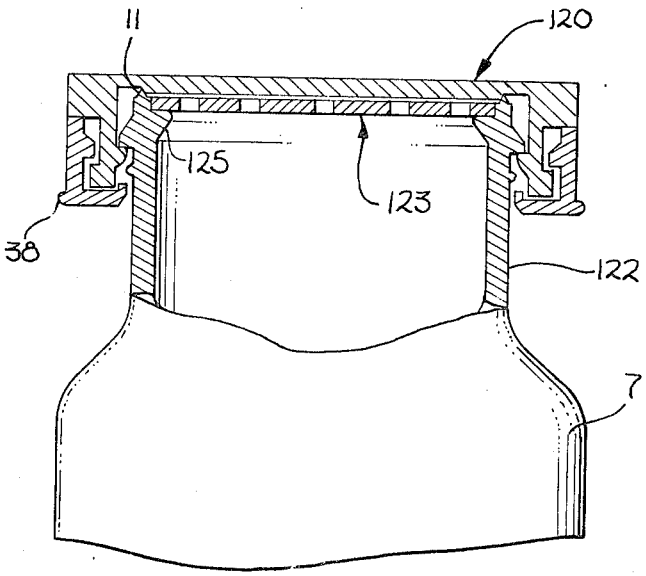
Fig. 21

CHILD RESISTANT SAFETY CAP

BACKGROUND OF THE INVENTION

1. Field of the Invention

This invention relates to safety closures for containers and has particular reference to closures including a snap-on cap and safety ring. These closures are frequently called child resistant closures because they tend to prevent children from readily opening the containers.

2. Prior Art

Various safety closures are described in the prior art. For example, the safety closures disclosed in U.S. Pat. Nos. 3,612,322 and 3,693,820 comprise a snap-on cap held in place on a container by a rotary safety ring which must be aligned with the cap in one angular position and pushed downwardly away from the cap before one can remove the cap from the container. The ring is locked around a portion of the cap by fingers, which extend either from the inside of the ring or from the cap, and which fingers fit into a locking groove formed between the ring and cap. The ring is unlocked by aligning it with the cap in one angular position so that the fingers slide through release grooves in the locking groove when the ring is pulled downwardly away from the cap. Then the cap can be removed.

While these safety closures have generally worked well, it has become apparent that the safety ring can be difficult to open by an adult even when the adult knows how to open the closure. Furthermore, these closures are not ideally suited for containers of liquids; the fit between the cap and the mouth of the container is frequently not tight enough to provide a liquid-tight seal. This is true despite the seal element disclosed in U.S. Pat. No. 3,612,322, which just makes the underside of the cap thicker.

The present invention improves the prior closures by, for instance, providing an outwardly directed bead on the safety ring which makes it easier to grip and push down (and up) the safety ring. Thus, people with arthritis and similar afflictions will have less difficulty moving the safety ring down away from the cap. Secondly, this invention discloses an annular protrusion projecting from the underside of the cap which protrusion closely abuts the rim of the container so that the protrusion and rim act as a liquid-tight seal. The seal of the bottle is further improved by a circumferential knob around the neck of the container. The knob prevents the safety ring, and hence the cap locked thereto, from moving upwardly, thereby keeping the annular protrusion close to the rim. Also disclosed herein is an improved safety ring and cap assembly which has no lateral opening between the safety ring and the cap. This improvement removes the opening because it could be used by a child attempting to open the container by forcing his fingers or teeth into the opening. Finally, this invention describes various ways to incorporate on the closure means for counting the number of uses or doses of the container's contents.

SUMMARY OF THE INVENTION

The present invention provides a safety closure of the general type described above having an annular protrusion which projects from the underside of the cap and which has a diameter slightly less than the inside diameter of the rim of the container. This protrusion, made so that it closely abuts the rim of the container when the cap is securely closed, and the rim of the container make a liquid-tight seal; that is, liquid cannot flow through the seal. This invention also improves the seal of the container by providing a circumferential knob around the neck of the container. The knob keeps the annular protrusion closely abutted to the rim of the container by preventing upward movement of the safety ring and cap assembly. The knob engages a portion of the safety ring when the ring is locked around the cap.

Another feature of the present invention provides an outwardly directed bead on the outside of the safety ring. When one grabs the ring, the bead will protrude into one's finger and make it easier to push the ring up or down.

This invention improves the safety closures described in the prior art by disclosing a safety ring which extends up to the top of the cap so that there is no lateral opening between the safety ring and the cap.

This invention also provides various counters to count the number of uses or doses of the container's contents. These counters, located on the safety ring of the general type described above, include at least one set of numbers appearing around the outside of the safety ring. Any one of these numbers can be aligned with an indicia of position on a cylindrical strap surrounding the safety ring. Alternatively, any one of these numbers can be aligned with any number from a second set of numbers appearing around a cylindrical strap surrounding the safety ring.

Further, this invention discloses specific embodiments of these features. Two such embodiments, a safety closure for a powder container with a sifter inserted in the mouth of the container, and a pipette dropper safety closure, show the various features of this invention.

The following detailed description, together with the drawings, will illustrate, by way of example, the principles, features and advantages of the invention.

DESCRIPTION OF THE DRAWINGS

FIG. 5 shows the ring locked on the cap.

FIG. 7, an enlarged vertical cross-sectional view of the safety closure, shows the cap and safety ring aligned in the one angular position from which the ring can be moved downwardly away from the cap. In this view, the tab 19 of the ring and the fingers 26 of the cap are overlapping (i.e., aligned).

FIG. 8 shows the ring fastened to the cap. FIG. 9 is an enlarged perspective view of the underside of the cap.

FIG. 12 shows an enlarged view of the safety closure equipped with a safety ring for counting the number of uses or doses of the container's contents in a particular day.

FIG. 13 is an enlarged fragmentary view of the safety closure shown in FIG. 12, taken along the line 13—13 of FIG. 12. The cap and safety ring, but not the neck of the container, are shown in a cross-sectional view.

FIG. 14 shows a top view of the pipette dropper safety closure.

FIG. 15 shows a side view of the pipette dropper safety closure.

FIG. 16 is an enlarged vertical cross-sectional view of the pipette dropper safety closure; FIG. 16 is taken along line 16—16 of FIG. 17.

FIG. 17 shows an enlarged cross-sectional view of the pipette dropper safety closure.

FIG. 18 shows a top view of the safety closure for powder bottles.

FIG. 19 shows a top view of the safety closure for powder bottles; the cap has been removed.

FIG. 20 shows an enlarged cross-sectional view of the safety closure for powder bottles.

FIG. 21 shows an enlarged cross-sectional view of the safety closure, with the cap attached to the bottle, for powder bottles.

FIG. 22 is an enlarged fragmentary view, partly in cutaway section. It shows the upper end of the ring being substantially even with the top of the cap.

DETAILED DESCRIPTION OF THE INVENTION

Figure 1:
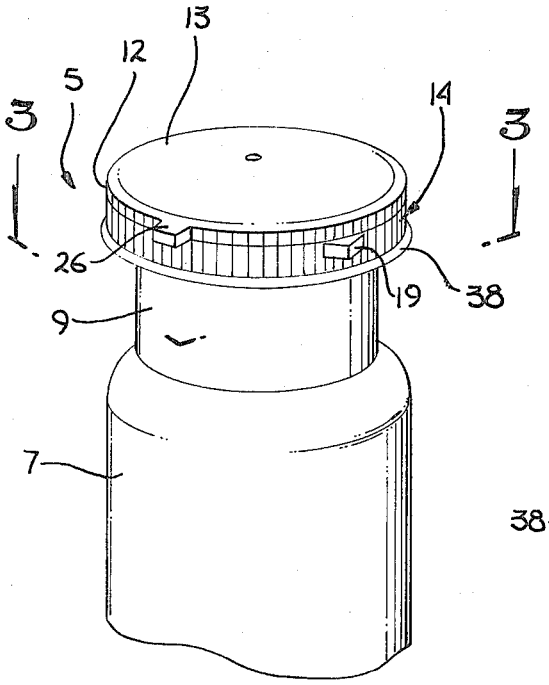
FIG. 1 is a perspective view of the safety closure of this invention on a container and shows the ring locked on the cap.
Figure 2:
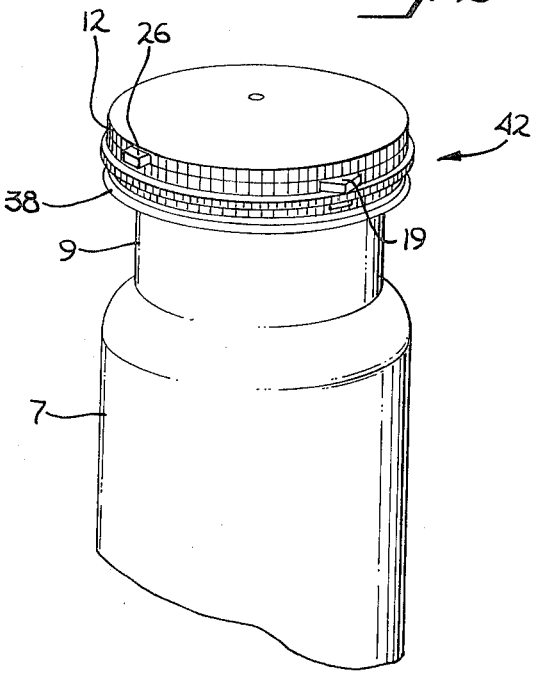
FIG. 2 is a perspective view of the safety closure, equipped with a safety ring for counting the number of uses or doses of the container's contents, of this invention on a container and shows the ring locked on the cap.
Figure 6:
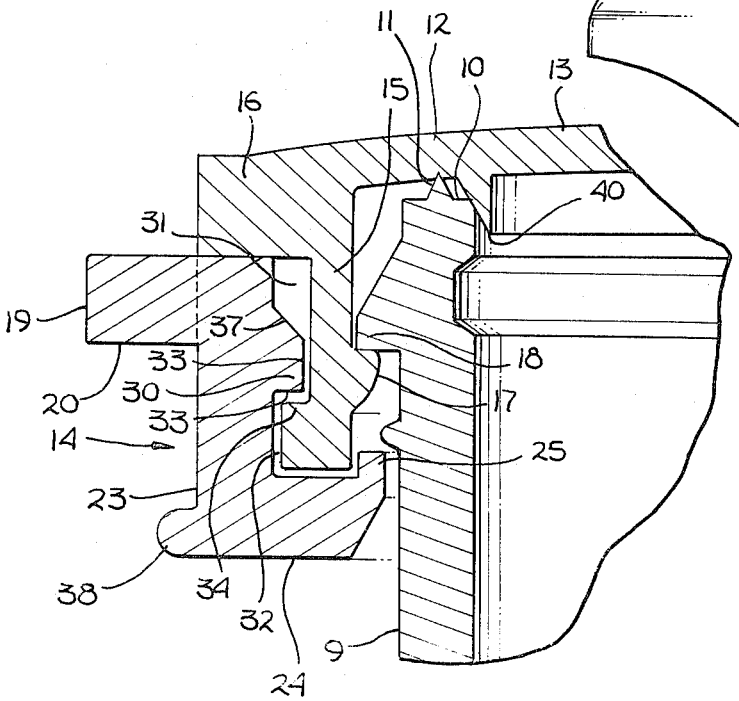
FIG. 6, taken along lines 6—6 of FIG. 5, shows an enlarged cross-sectional view of the safety closure, including the safety ring, cap, and the neck of the container.

The present invention, embodied in a new and improved safety closure for a container, is illustrated in the exemplary drawings. Referring to FIGS. 1 and 6, the safety closure 5, designed for a container 7 having a neck 9 and a rim 10 defining an open mouth, generally comprises a flexible, snap-on cap ("cap") 12 covering the mouth of the container and a rotary safety ring ("safety ring") 14, which holds the cap on the container when the ring overlies a portion of the cap.

To better define this invention, the following words will be explained. Longitudinal (and longitudinally), as used to describe and claim this invention, means along the length of the container; that is, along a line extending from the cap, through the ring and down through the neck to the bottom of the container. This line is, of course, a vertical line when the container sits normally on its bottom on a flat surface. lateral (and laterally), as used to describe and claim this invention, means along the width of the container; that is, along a line extending from one point of the cap, or ring, or container, to a diametrically opposed point on the cap, ring or container, respectively. These lines are horizontal when the container sits normally. The term "container" includes glass bottles, paper containers, molded plastic containers (e.g., thermoplastic, thermosetting and laminated plastic bottles), metal containers and similar containers having a neck and a rim defining an open mouth.

Referring primarily to FIGS. 1, 5, 6 and 9, the cap 12 has a top 13 overlying the rim 10 of the container 7 and a depending annular flange (depending flange or depending annular flange member) 15 which projects downwardly from the top and surrounds an upper portion of the neck 9. An outwardly projecting radial flange 16 is the portion of the top which extends beyond the depending annular flange member 15. Near the lower end of the depending flange 15 is an inwardly directed circumferential bead 17 which engages a peripheral lip 18 surrounding the rim 10 when the cap is secured to the container. The peripheral lip 18 projects outwardly around the rim of the container and, together with the inwardly directed circumferential bead 17 of the depending flange 15, forms an interfitting means between the cap and the container. The cap 12 is attached to the container 7 by pressing the cap downwardly over the rim 10, which causes the depending flange 15 to flex outwardly to allow the inwardly directed circumferential bead 17 to slip over the peripheral lip 18 of the container and then to flex inwardly back to its original position, where it engages the peripheral lip 18. The cap 12, when attached to the container 7, presses against the extension 11 of the rim 10, thereby providing a seal.

Figure 3:
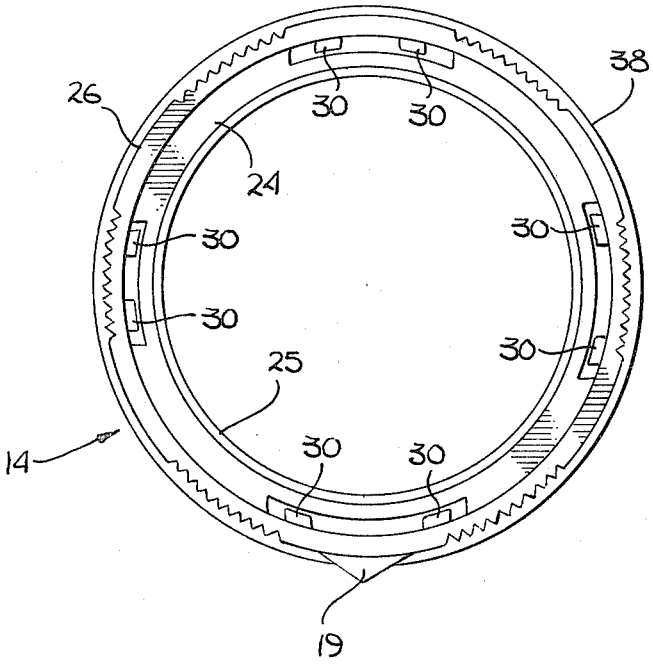
FIG. 3 shows a cross-sectional view of the safety ring, taken along the line 3—3 of FIG. 1.
Figure 4:
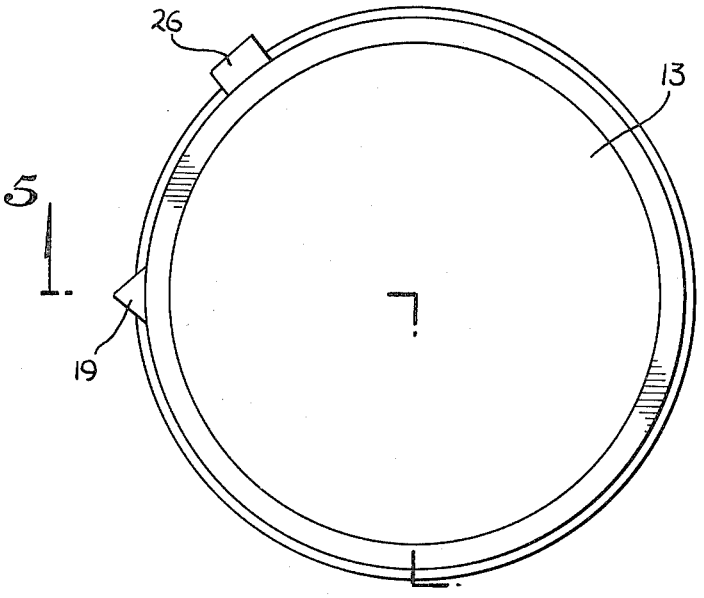
FIG. 4 shows a top view of the cap and safety ring in an angular position from which the ring can not be moved downwardly away from the cap; the ring and cap are locked together.
Figure 5:
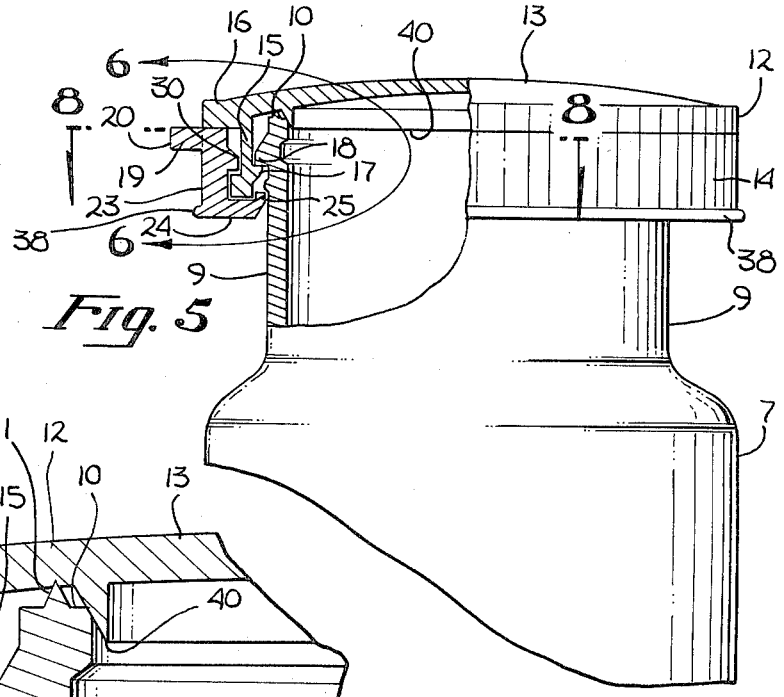
FIG. 5 is an enlarged fragmentary view, partly in cutaway section, taken along the lines 5—5 of FIG. 4.

The safety ring 14 normally surrounds the depending annular flange 15 to block outward flexing of the depending flange, and thereby prevents the inwardly directed circumferential bead 17 from slipping over the peripheral lip 18 when one attempts to lift the cap 12. Vertical serrations completely around the safety ring 14 may be added to make it easier to grip the ring. The safety ring 14 generally has an L-shaped vertical cross section, as shown in FIG. 6. The tab 19 of the safety ring, as shown in FIGS. 1 and 3, forms the outwardly projecting lateral wall 20 of the safety ring which appears in FIGS. 5 and 6. The section, as shown in FIG. 6. The tab 19 of the safety ring, as shown in FIGS. 1 and 3, forms the outwardly projecting lateral wall 20 of the safety ring which appears in FIGS. 5 and 6. The generally L-shaped vertical cross-section of the safety ring is formed by an annular sidewall 23 and an inwardly projecting bottom wall 24 which extends to the neck 9 of the container 7. The sidewall 23 encircles the depending flange 15 of the cap when the closure is locked, and the bottom wall 24 strengthens the sidewall and assists in positioning the safety ring on the container. The bottom wall 24 also prevents the safety ring from sliding off the neck of the container by engaging the peripheral lip 18 when the safety ring slides down the neck, as it does when the container is tilted to remove the container's contents. As shown in FIGS. 3, 5 and 6, an upwardly projecting flange 25 may be provided on the inner end of the bottom wall to help keep the safety ring around the neck of the container. This invention discloses below another use of this flange.

To release the cap 12 for removal from the container 7, the safety ring 14 must be precisely aligned in a preselected angular position relative to the cap 12. The tab 19 of the safety ring and the finger 26 of the cap can be used to indicate when the safety ring is precisely aligned in the preselected angular position relative to the cap. When the finger 26 overlaps the tab 19, as shown in FIG. 7, the safety ring 14 is precisely aligned with the cap 12, so that the safety ring can be pushed downwardly away from the cap. The safety ring can be pushed downwardly away from the cap only when the ring is precisely aligned with the cap. Thus, the safety ring 14 of the containers shown in FIG. 1, 2, 4, 5 and 6, being misaligned with the cap 12, cannot not be pushed downwardly away from the cap. Hence, these containers are "locked"; that is, the safety ring is locked around the cap.

Of course, devices other than a tab and finger can be used to indicate when the safety ring is properly aligned relative to the cap. For example, an indentation, rather than a finger, may be used in the cap. As shown in FIG. 9, an indentation 8 in the cap 12 provides a convenient way to align the cap 12 and ring 14. The indentation 8 in the cap 12 is the preferred embodiment of the invention because a cap with a finger 26 can be more easily forced off the container (by inserting a sharp object between the finger and the top of the ring) than a cap with an indentation.

Once the safety ring is moved from its position around the depending flange 15 by slipping it downwardly off the cap and onto the neck 9 of the container, the cap 12 can be lifted off the container 7 since the depending flange 15 is now free to flex outwardly. As one pulls the cap up, the outward flexion of the depending flange 15 permits the inwardly directed circumferential bead 17 to slip around the peripheral lip 18. When the container 7 is to be reclosed, the cap 12 is pressed back onto the neck 9, so that the inwardly directed circumferential bead 17 slips around and under the peripheral lip 18. Then the safety ring is raised back into the locked position so that the annular sidewall 23 encircles the depending flange 15 of the cap 12. The safety ring can be raised back into the locked position in any angular position with the cap; no alignment of cap and safety ring is necessary.

As shown in FIGS. 3, 5 and 6, the safety ring locks around the depending flange by at least one, and preferably several, resiliently flexible fingers 30 which may be angularly spaced about the inside of the annular sidewall 23. The safety ring shown in FIG. 3 has eight such fingers 30. The angularly spaced, flexible fingers 30, connected at one end to the inside of the annular sidewall 23 of the safety ring 14, project inwardly into a circumferential locking groove 31 formed around the depending flange 15 of the cap 12 to lock the ring in position around the cap. The locking groove 31 is defined by an outwardly directed circumferential bead 32 located near the bottom of the depending flange 15, the outwardly projecting radial flange 16 of the top 13 and the longitudinal portion of the depending flange 15.

As shown in FIGS. 3, 5 and 6, the fingers 30 project inwardly into the locking groove 31 when the safety ring 14 is in place around the depending flange 5 and have free inner ends 33 which overlie an upwardly facing shoulder 34, which forms the bottom wall of the locking groove 31. The fingers 30 closely approach the longitudinal portion of the depending flange 15. The upwardly facing shoulder 34 defines the top of the outwardly directed circumferential bead 32. Thus, if a downward force is applied to the ring 14 while the fingers 30 overlie the upwardly facing shoulder 34 (and thus overlie the outwardly directed circumferential bead 32), the resulting downward motion of the fingers 30 relative to the shoulder 34 wedges the free ends 33 of the fingers 30 downwardly into the shoulder. This longitudinal wedging of the fingers 30 against the shoulder 34 prevents further downward movement of the safety ring since such movement can occur only if the fingers buckle longitudinally, which requires an extremely large force. Accordingly, the fingers 30 and the locking groove 31 hold the cap in place when the safety ring is positioned around the depending flange 15.

To allow the fingers 30 to move out of the locking groove 31 when the safety ring 14 is to be unlocked for removal of the cap 12, a number of longitudinally extending release grooves 35, shown in FIG. 7, are formed in the outer side of the depending flange 15 between the locking groove 31 and the lower end of the flange. The number of release grooves is equal to the number of fingers 30 on the safety ring. Thus, the depending flange 15, designed to work with the safety ring 14 depicted in FIG. 3, has eight release grooves 35. The release grooves 35 extend from the locking groove 31 through the upwardly facing shoulder 34 to the lower longitudinal end of the depending flange 15. The fingers 30 and the release grooves 35 are formed in a special manner to prevent downward movement of the ring except in one angular position of the ring with regard to the cap, thus limiting the release of the cap to that one position. Preferably, the fingers 30 and associated release grooves 35 are of different sizes so that the ring 14 is releasable in only one angular position. Each of the release grooves 35 is to be aligned with a particular finger, which alignment occurs in the one preselected angular position (when, as noted above, the finger 26 of the top 13 overlaps the tab 19 of the safety ring). Each of the release grooves 35 is slightly larger than its associated finger 30 and, when properly aligned with the finger, will permit it to slide from the locking groove 31 through the release grooves 35 in the outwardly directed circumferential bead 32 and off the cap 12.

Once the ring 14 has been slipped off the cap 12, the cap can be pulled off the container 7 to allow dispensing of its contents. To replace the cap 12 and lock it in position on the container 7, the cap is snapped over the rim 10, and the ring 14 is pushed upwardly into position around the depending flange 15. Since the fingers 30 are flexible and inclined inwardly and have an upper edge 37 which is inclined downwardly, no prealignment of the fingers and the release grooves 35 is necessary. When the safety ring 14 is moved upwardly with the fingers 30 out of alignment with their release grooves 35, the outwardly directed circumferential bead 32 of the depending flange 15 deflects the fingers 30 and annular sidewall 23 of the safety ring outwardly. The outward deflection occurs as the upper edge 37 of the fingers slides over the outwardly directed circumferential bead 32. Then, as the safety ring 14 reaches the fully seated positon in which the top of the annular sidewall 23 abuts against the underside of the top 13 of the cap 12, the fingers are aligned in the locking groove, thereby locking the safety ring 14 to the cap 12. Thus, the safety ring can be returned into locking position around the cap without aligning it with the cap.

The fingers 30, as illustrated in FIGS. 3, 5 and 6, have generally rectangular cross-sections and are integrally joined to the safety ring 14. In addition, a plurality of recesses may be formed in the annular sidewall, such recesses being aligned with the fingers to receive them substantially flush with the annular sidewall as the safety ring is move back upwardly onto the cap. Alternatively, the fingers may be formed as cutouts from the annular sidewall 23 of the safety ring 14, such cutouts being integrally joined to the safety ring at their upper ends, and a plurality of recesses being formed from the spaces from which the fingers were cut.

Although the above description discloses fingers 30 formed on the safety ring 14 and the cooperating locking grooves 31 and release grooves 35 formed in the cap 12, the fingers can be formed on the cap and the grooves in the ring. In this latter situation, the fingers 30 will be inclined outwardly and upwardly from the cap 12 and the release grooves 35 will extend from the locking groove 31 upwardly to the upper end of the annular sidewall 23 of the safety ring. In either case, the fingers can be formed and set in the extended condition by conventional plastic molding techniques.

As illustrated in FIGS. 1, 5 and 6, this invention provides an outwardly directed bead 38 on the outside of the annular sidewall 23 of the safety ring 14. The bead 38 allows one to more easily grip and move the safety ring 14; removing the safety ring from the cap and replacing the safety ring onto the cap are much easier with the bead 38 than without it. The word "bead," as used to describe and claim this element of the present invention, means any protrusion, regardless of the shape of its vertical cross-section, which provides a means for gripping the safety ring 14. Thus, the bead could have a rectangular, triangular or circular vertical cross-section; all such beads are included within the term "bead". The outwardly directed bead 38, illustrated in FIGS. 5 and 6, has a roughly circular vertical cross-section because such a shape is gentler on one's fingers.

Preferably, the outwardly directed bead 38 is located at the lower end of the annular sidewall 23 of the safety ring 14, as illustrated in FIGS. 5 and 6, and surrounds the entire annular sidewall 23. However, the bead 38, in order to function, need not surround the entire annular sidewall 23; for example, it may extend only around most of the sidewall. Also, there may be two separate outwardly directed beads, diametrically opposed on the annular sidewall 23, which extend only around part of the sidewall. Similarly, four separate outwardly directed beads 38, each located in a quadrant of the annular sidewall 23 and each extending only around a portion of its quadrant, may be provided. Similar arrangements of the bead 38 can be envisioned in accordance with this invention.

The outwardly directed bead 38 should be made large enough so that it provides a sufficient grip for one's fingers when one pushes the safety ring 14 up or down, but it should not be so large that it makes the operation of the counters, described below, difficult.

To open the container 7, one grasps the safety ring 14 with one's fingers, which engage the outwardly directed bead 38. Then, as one applies a downward force on the safety ring 14 and the outwardly directed bead 38, the bead converts much of this force into movement of the safety ring. Without the bead, one's fingers may just slip off the ring without moving the safety ring 14. To replace the ring, one simply grasps the ring from its underside and pushes upwardly; again the bead assists in the movement of the ring.

As illustrated in FIGS. 5, 6, 7, and 9, this invention provides an annular protrusion 40 which projects from the surface of the underside of the top 13. The annular protrusion 40 has an average diameter slightly less than the inside diameter of the rim 10 of the container 7. When the cap 12 is securely closed on the container 7, the annular protrusion 40 closely abuts the rim 10, thereby sealing the contents of the container. This seal tends to be liquid-tight and, of course, will help keep gases from flowing in and out of the container 7. Naturally, the protrusion must form a complete circle if the rim 10 forms a complete circle. That is, whatever the shape of the rim 10 of the container 7, the annular protrusion 40 must, in order to operate according to this invention, have the same shape and fit tightly inside the rim 10.

The annular protrusion 40 projects below the top far enough that it will closely abut the rim 10 when the cap 12 is pressed back onto the neck 9. Typically, the projection of the annular protrusion is about equal to the thickness of the top 13, as indicated by FIG. 6. The cap 12 is pressed back onto the neck 9 when the inwardly directed circumferential bead 17 slips around and under the peripheral lip 18. Thus, to operate in accordance with this invention, the annular protrusion 40 must be made so that it closely abuts the rim 10 when the inwardly directed circumferential bead 17 slips around and under the peripheral lip 18.

The shape of the vertical cross-section of the annular protrusion 40 may be rectangular, triangular, circular or any other shape which would assure that the fit between the rim 10 and the annular protrusion 40 is liquid-tight. Preferably, as shown in FIGS. 5 and 6, the annular protrusion 40 has a triangular vertical cross-section.

To improve the effectiveness of the seal, this invention provides a circumferential knob 22 which keeps the annular protrusion 40 closely abutted to the rim 10 when the ring 14 is locked around the cap 12. This circumferential knob 22 is illustrated in, interalia, FIGS. 5 and 6. The circumferential knob 22, located on the neck 9 of the container 7, blocks the upward movement of the ring 14 by wedging against the upwardly projecting flange 25 of the safety ring 14. Thus, when the ring 14 is locked around the cap 12, the cap 12 cannot be moved upwardly once the knob 22 wedges against the upwardly projecting radial flange 25. The knob 22 is positioned near the rim 10 of the container so that, as one pulls the cap up, the knob 22 wedges against the upwardly projecting radial flange 25 before the seal between the annular protrusion 40 and the rim 10 is destroyed. In the preferred embodiment, the knob 22 is located below the peripheral lip 18 of the container 7 and must be at least large enough, regardless of its shape, to block the flange 25. When the safety ring 14 is locked around the cap 12, the knob 22 normally is not wedged against the radial flange 25; that is, in the normal locked position, the ring and cap assembly must be moved upwardly to wedge the knob 22 against the flange 25. However, once the ring and cap assembly is moved slightly upwardly from its normal locked position, it should immediately be blocked by the wedging of the knob 22 against the flange 25. Consequently, the circumferential knob 22 protects the seal, created by the annular protrusion 40 and the rim 10, from forceful attempts to open the container. This knob 22 is also important because the manufacturing tolerances of the cap, container, and ring sometimes cause the locked assembly (i.e., the cap and ring when the ring is locked around the cap) to move vertically, thereby affecting the liquid-tight seal.

Another element disclosed by this invention is an improved ring and cap assembly, which allows no lateral openings between the cap and the ring. As shown in FIG. 22, the cap 150 does not have an outwardly projecting radial flange 16 (shown in FIG. 6) superimposed over the ring 160. In all other respects, the cap 150 is substantially identical to the cap 12 described above. Thus, for example, the cap 150 has an inwardly directed circumferential bead 17 which engages the peripheral lip 18 of the container 7 and has a depending flange 15. The ring 160 has an enlarged annular sidewall 161, corresponding to the annular sidewall 23 of the ring 14 described above (refer to FIG. 6 and accompanying description). In all other respects, the ring 160 is substantially identical to the ring 14 described above.

The annular sidewall 161 extends up to the upper edge of the top 151 of the cap 150 so that the upper end 162 of the annular sidewall 161 is substantially even with the upper edge of the top 151. Thus, there is no lateral opening between the ring 160 and the cap 150 which could be used by a child attempting to open the container by forcing his fingers or teeth into such an opening. The upper end 162 should extend at least above the underside of the cap 150.

Figure 10:
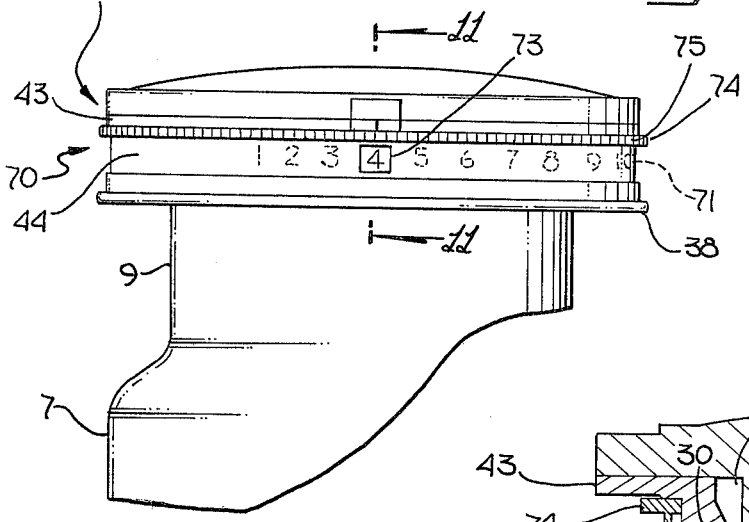
FIG. 10 is an enlarged view of the safety closure equipped with a safety ring for counting the number of uses or doses of the container's contents.
Figure 11:
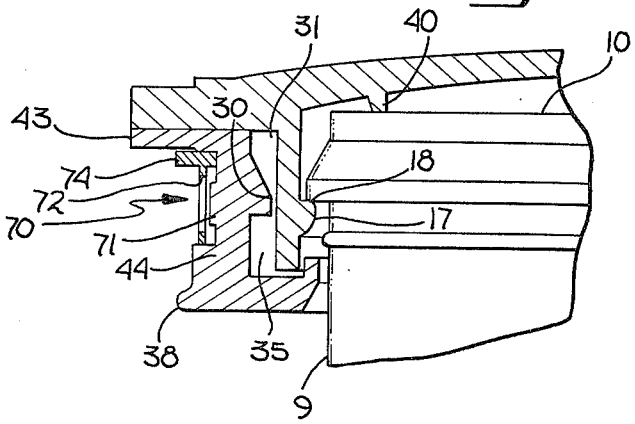
FIG. 11 is an enlarged view of the safety closure shown in FIG. 10, taken along the line 11—11 of FIG. 10. The cap and safety ring, but not the neck of the container, are shown in a cross-sectional view.

Also provided by this invention are various means shown in FIGS. 2, 10, 11, 12, and 13 to count the number of uses or doses of the container's contents. These means for counting are embodied in various counters described below. More particularly, FIGS. 10 and 11 show a safety closure 42 equipped with a counter 70 for counting the number of uses or doses of the container's contents. The safety closure 42 is structurally and functionally identical to the safety closure 5 described and illustrated above, except for the safety ring 43, which is modified for the counter 70. The counter 70, located on the safety ring 43, includes a set of numbers 71 appearing around the outside of the annular sidewall 44 of the safety ring 43 and a cylindrical strap 72 with a window-like aperture ("window") 73 appearing thereon. The cylindrical strap 72 snugly surrounds the annular sidewall 44 and overlies the set of numbers 71 appearing around the outside of the annular sidewall 44. The set of numbers 71 are stationary, as they are fixed to the outside of the annular sidewall 44. Normally, the numbers in the set of numbers 71 are integers which appear sequentially around the annular sidewall "50", the latter number being determined largely by the size of the numbers and the size of the annular sidewall. The cylindrical strap 72, on the other hand, can be rotated around the annular sidewall 44, thereby allowing one to place the window-like aperture 73 in front of any number from the set of numbers 71. The cylindrical strap 72 is preferably made from opaque plastic, and an annular bar 74, with serrations 75 thereon to allow one to more easily grasp the bar, may be attached to the upper (or lower) end of the cylindrical strap 72 to make rotation of the strap easy. The cylindrical strap 72 may also be made from a transparent material, such as plastic, and the window-like aperture 73 may be marked or otherwise fixed on the cylindrical strap 72. Preferably, the window-like aperture 73 consists of clear plastic or a rectangular opening in the opaque plastic of the cylindrical strap 72.

To count the number of uses or doses of the container's contents, one merely rotates the window-like aperture 73 so that the window-like aperture appears in front of the number of doses taken or number of uses. For example, after one has taken the first dose, one places the window 73 in front of the number 1 appearing on the annular sidewall 44; then after one has taken the second dose, one places the window 73 in front of the number 2, and so on. One can count the number of uses in a particular day or any other period of time; alternatively, one can count the total number of doses or uses of the container's contents Furthermore, if the largest number from the set of numbers 71 is large enough, one could count the number of pills (or doses) or uses remaining in the container 7.

The window-like aperture 73, which serves as an indication of position, could, in accordance with this invention, be replaced by other means for indicating a positon on the cylindrical strap 72. For example, an arrow or notch appearing on the cylindrical strap, which arrow or notch could be aligned with any number from the set of numbers 71, could be used as a means for indicating position.

Another means for counting, illustrated in FIGS. 12 and 13, involves a safety closure 45 equipped with a counter 80 for counting the number of uses or doses of the container's contents in a particular day or other period of time. The safety closure 45 is structurally and functionally identical to the safety closure 5 described and illustrated above, except for the safety ring 46, which is modified for the counter 80. The counter 80, located on the safety ring 46, includes a first set of numbers 81 appearing around the outside of the annular sidewall 47 of the safety ring 46 and a cylindrical strap 82, on which appears a second set of numbers 83. The cylindrical strap 82 snugly surrounds the annular sidewall 47 and overlies the first set of numbers 81 appearing around the outside of the annular sidewall 47.

The first set of numbers 81 are stationery, as they are fixed to the outside of the annular sidewall 47. The second set of numbers 83 are fixed on the cylindrical strap 82 and, hence, rotate with the cylindrical strap 82 when the strap is rotated. As shown in FIG. 13, the second set of numbers 83 are molded on the outer wall of the cylindrical strap 82 and the first set of numbers 81 are molded on the annular sidewall 47; the plane defined by the first set of numbers 81 is fixed above the plane defined by the second set of numbers 83, and so, the first set of numbers 81 appears juxtaposed above the second set of numbers 83. The relationship of these two planes may be reversed so that the second set of numbers 83 appears juxtaposed above the first set of numbers 81. To further assist in distinguishing between the sets of numbers, the first set of numbers 81 may be made in a particular color, and the second set of numbers 83 may be another color. Normally, the numbers in the first and second sets of numbers 81 and 83 appear sequentially around the annular sidewall 47 and cylindrical strap 82, respectively. The numbers in both sets 81 and 83 are integers which appear sequentially from "1" to about "50", the latter number being determined largely by the size of the numbers and the size of the annular sidewall 47 or cylindrical strap 82 (whichever the case may be). Preferably, the numbers in the first set of numbers 81 are the integers "1" through "31", as shown in FIG. 12; these integers may be used to represent any day in any month. Each number in the second set of numbers 83 may be fixed within the perimeter of a rectangular, window-like marking 84 on the cylindrical strap 82. FIG. 12 shows only one such marking. The window-like marking 84 may be made large enough that the number from the first set of numbers 81, which appears juxtaposed longitudinally to the number from the second set of numbers 83, is included within the perimeter of the window-like marking 84.

The cylindrical strap 82 can be rotated around the annular sidewall 47, thereby allowing one to place any number from the second set of numbers 83 in longitudinal juxtaposition with any number from the first set of numbers 81. The rectangular, window-like markings 84, the perimeter of which surrounds each number in the second set of numbers 83, may be used to verify that one particular number from the second set is longitudinally juxtaposed with a number from the first set. The cylindrical strap 82 is preferably made from clear plastic which fits snugly around the annular sidewall 47, yet not so snugly that the strap 82 is difficult to rotate; the strap 82 shown in FIGS. 12 and 13 has two annular bars 85 and 86, which have serrations 87 thereon to allow one to more easily grasp the bars, one 85 at the lower end and one 86 at the upper end of the cylindrical strap 82. These bars 85 and 86 help to make rotation of the strap 82 easy.

To count the number of uses or doses of the container's contents in a particular day, one rotates the cylindrical strap 82 so that the number of doses taken (or uses) appears juxtaposed longitudinally with the date of the month. For example, if one has just taken the eighth dose for the second day of June, one places the number "8" from the second set of numbers 83, which appears below the first set of numbers 81 in this particular example, under the number "2" from the first set of numbers 81. The tab 19 on the safety ring 46 may be used as an indication of position, just as the window-like aperture 73 is used to indicate position on the counter described above; thus, using this tab 19, one can use the counter illustrated in FIGS. 12 and 13 as if it were the counter illustrated in FIGS. 10 and 11.

One should appreciate that letters may be used in lieu of numbers on the counters described herein. For instance, letters, such as the alphabet, appearing around the safety ring 44, shown in FIG. 10, could be used to count the number of doses or uses of the container's contents. The size of the ring should be large enough so that the numbers can be read, but not so large as to make the ring difficult to work.

As FIGS. 14, 15, 16, and 17 show, the invention disclosed herein can be applied to other kinds of containers which accept the safety closures described herein. Referring primarily to FIGS. 15 and 17, the safety closure 100, generally identical in structure and function to the safety closure 5 described above, appears on a pipette dropper container 101. The safety closure 100 is identical to the safety closure 5 described above ans shown in FIGS. 1, 5, 6, and 7 except that the cap 102 accepts a pipette dropper 103 or other means for drawing and holding fluid into a vessel. The structure and function of the outwardly directed bead 38, the annular protrusion 40, the counters 70 and 80, and the structure and function of all other elements of the safety closure 100 which are identical to those elements embodied in the safety closure 5 shall not be discussed again; the reader should refer back to the description of the safety closure 5.

The pipette dropper 103 includes a squeezable bulb 104 and a pipette 105. The cap 102 has a circular hole 106 through which the squeezable bulb 104 passes. The pipette 105, when the closure is closed, usually extends from about the surface of the underside of the top 13 to almost the bottom of the container 101. The pipette 105, which may be glass, plastic or other materials capable of holding liquids, has an outwardly directed circumferential ridge 107 near its top which engages a circumferential channel 108 located near the bottom of the squeezable bulb 104. The ridge 107 and channel 108 are made so that the ridge 107 fits tightly within the channel 108 and, hence, the pipette is securely attached to the squeezable bulb 104.

The squeezable bulb 104 extends from about 2 inches above the top 13 to about ½ inch below the underside of the top 13. The bulb 104 has thicker, less flexible walls 109 immediately around the area where it passes through the top 13 and where it engages the pipette 105. The bulb 104 is attached to the top 13 by a circular groove 110 in the bulb's thicker, less flexible walls 109; the edges of the circular hole 106 engage the circular groove so that the squeezable bulb 104 is tightly attached to the top. The squeezable bulb 104 is bonded to the cap 102 so that a child cannot pull it out of the cap. Typically, the circular groove 110 is located just above the circumferential channel 108.

FIGS. 18, 19 20 and 21 show a further example of how the invention disclosed herein can be applied to other kinds of containers which accept the safety closures described herein. The safety closure 120, generally identical in structure and function to the safety closure 5 described above, appears on a powder container (that is, a container intended to hold and dispense powder). The safety closure 120 is identical to the safety closure 5 described above and shown in FIGS. 1, 5 and 6, except that the cap 121 has no annular protrusion, such as the annular protrusion 40 in FIGS. 5 and 6, and the neck 122 of the container 7 accepts a sifter 123. The structure and function of the outwardly directed bead 38, the counters 70 and 80, and the structure and function of all other elements of the safety closure 120 which are identical to those elements embodied in the safety closure 5 shall not be discussed again; the reader should refer back to the description of the safety closure 5.

The sifter 123 is a circular disc, formed to fit tightly inside the neck 122 of the container 7. It has perforations 124 which are designed to allow the powder or other granular material stored in the container 7 to escape when the container 7 is turned upside down. The sifter, which has a diameter very slightly less than the inner diameter of the neck 122 where it is designed to fit, rests on a circular lip 125 which projects inwardly. The circular lip 125 is located near the rim 126 of the container so that the top 127 of the sifter 123 is flush with the rim 126. The extension 11 of the rim 126 presses against the cap 121 when the cap is attached to the container 7 so as to prevent moisture or liquid from penetrating into the container.

While a particular form of the invention has been illustrated and described, it will be apparent that other modifications can be made without departing from the spirit and scope of the invention.

We claim:

1. A safety closure for a container having a rim defining an open mouth and a peripheral lip around the rim, said closure comprising:

a cap having a top overlying said mouth and said rim and having a depending annular flange projecting below said top, said flange having an inwardly directed circumferential bead engaged below said lip, and an outwardly directed circumferential bead located below said top and cooperating therewith to define a circumferential locking groove extending around the outer side of said flange;

a rotary safety ring having an annular sidewall surrounding said flange and overlying said locking groove and said outwardly directed circumferential bead, said annular sidewall being closely spaced to said locking groove and said outwardly directed circumferential bead so that said inwardly directed bead is held in engagement with said lip and prevents removal of said cap;

a plurality of angularly spaced fingers on the inner side of said sidewall projecting into said locking groove and overlying the bottom wall of said groove to prevent downward movement of said ring along said cap, said fingers being inclined inwardly and downwardly into said locking groove having free inner ends positioned to be wedged against the bottom of the locking groove to prevent free flexing of the fingers as the ring is pulled downwardly relative to the cap, thereby normally preventing downward movement of said ring out of overlying relation with said locking groove;

a plurality of longitudinally extending release grooves in said outwardly directed circumferential bead, spaced and sized to permit movement of said fingers through said outwardly directed circumferential bead in one angular position of said ring about said cap, and thus allowing downward movement of said ring away from said cap for the removal of the latter from the container in said one angular position; and an annular protrusion projecting from the surface of the underside of said top, said protrusion having a diameter slightly less than the inside diameter of said rim so that said protrusion closely abuts said rim when said cap is securely closed on said container;

whereby a safety closure with an improved liquid-tight seal is disclosed.

2. A safety closure for a container having a rim defining an open mouth and a peripheral lip around the rim, said closure comprising:

a cap having a top overlying said mouth and said rim and having a depending annular flange projecting below said top, said flange having an inwardly directed circumferential bead engaged below said lip, and an outwardly directed circumferential bead located below said top and cooperating therewith to define a circumferential locking groove extending around the outer side of said flange;

a rotary safety ring having an annular sidewall surrounding said flange and overlying said locking groove and said outwardly directed circumferential bead, said annular sidewall being closely spaced to said locking groove and said outwardly directed circumferential bead so that said inwardly directed bead is held in engagement with said lip and prevents removal of said cap;

a plurality of angularly spaced fingers on the inner side of said sidewall projecting into said locking groove and overlying the bottom wall of said groove to prevent downward movement of said ring along said cap, said fingers being inclined inwardly and downwardly into said locking groove having free inner ends positioned to be wedged against the bottom of the locking groove to prevent free flexing of the fingers as the ring is pulled downwardly relative to the cap, thereby normally preventing downward movement of said ring out of overlying relation with said locking groove;

a plurality of longitudinally extending release grooves in said outwardly directed circumferential bead, spaced and sized to permit movement of said fingers through said outwardly directed circumferential bead in one angular position of said ring about said cap, and thus allowing downward movement of said ring away from said cap for the removal of the latter from the container in said one angular position; and an outwardly directed bead on the outer side of said ring;

whereby a safety closure with a safety ring which is easy to remove is disclosed.

3. A safety closure for a container having a rim defining an open mouth and a peripheral lip around the rim, said closure comprising:

a cap having a top overlying said mouth and said rim and having a depending annular flange projecting below said top, said flange having an inwardly directed circumferential bead engaged below said lip, and an outwardly directed circumferential bead located below said top and cooperating therewith to define a circumferential locking groove extending around the outer side of said flange;

a rotary safety ring having an annular sidewall surrounding said flange and overlying said locking groove and said outwardly directed circumferential bead, said annular sidewall being closely spaced to said locking groove and said outwardly directed circumferential bead so that said inwardly directed bead is held in engagement with said lip and prevents removal of said cap;

a plurality of angularly spaced fingers on the inner side of said sidewall projecting into said locking groove and overlying the bottom wall of said groove to prevent downward movement of said ring along said cap, said fingers being inclined inwardly and downwardly into said locking groove having free inner ends positioned to be wedged against the bottom of the locking groove to prevent free flexing of the fingers as the ring is pulled downwardly relative to the cap, thereby normally preventing downward movement of said ring out of overlying relation with said locking groove;

a plurality of longitudinally extending release grooves in said outwardly directed circumferential bead, spaced and sized to permit movement of said fingers through said outwardly directed circumferential bead in one angular position of said ring about said cap, and thus allowing downward movement of said ring away from said cap for the removal of the latter from the container in said one angular position; and means, located on said closure, for counting.

4. A safety closure as defined in claim 1, further comprising an outwardly directed bead on the outer side of said ring.

5. A safety closure as defined in claim 2, further comprising means, located on said closure, for counting.

6. A safety closure as defined in claim 1, further comprising:

an outwardly directed bead on the outer side of said ring; and means, located on said closure, for counting.

7. A safety closure as defined in claim 1, further comprising means, located on said closure, for counting.

8. A safety closure as defined in claims 1, 2, 3, 4, 5, 6, or 7 wherein the upper end of said sidewall extends above the surface of the underside of said cap so that said upper end is substantially even with said top.

9. A safety closure as defined in claims 1, 2, 3, 4, 5, 6, or 7 in which said fingers are integrally joined to said ring at their upper ends, and further including a plurality of recesses in said sidewall aligned with said fingers to receive them substantially flush with the sidewall as the ring is moved back upwardly onto said cap.

10. A safety closure as defined in claims 1, 2, 3, 4, 5, 6, or 7, further comprising:

a circumferential knob located on said container below said peripheral lip, said knob wedging against an upwardly projecting flange located on said ring when said ring is pulled up, so that said knob and said upwardly projecting flange prevent upward movement of said ring and said cap attached thereto.

11. A safety closure as defined in claims 1, 2, 3, 4, 5, 6 or 7 in which said fingers are of different sizes, and said release grooves are of correspondingly different sizes, to permit downward movement of said ring in only one angular position.

12. A safety closure as defined in claim 3 in which said means for counting comprises a set of numbers appearing around the outside of said sidewall of said rotary safety ring and a cylindrical strap having means for indicating a position on the strap, said strap overlying the outside of said sidewall on which the set of numbers appears, and said strap being capable of rotation around the safety ring so that any number appearing on the outside of said sidewall can be aligned with said means for indicating a position on the strap.

13. A safety closure as defined in claim 12 in which said means for indicating a position on the strap comprises at least one window on the strap through which the numbers appearing around the outside of said sidewall can be perceived.

14. A safety closure as defined in claim 12 in which said means for indicating a position on the strap comprises an arrow appearing on said strap which can be aligned with any number appearing on the outside of said sidewall to indicate said any number.

15. A safety closure as defined in claim 3 in which said means for counting comprises a first set of numbers appearing around the outside of said sidewall of said rotary safety ring and a cylindrical strap having a second set of numbers appearing on said strap, said strap overlying the outside of said sidewall on which the first set of numbers appears, and said strap being capable of rotation around the rotary safety ring so that any number from said first set of numbers can be aligned with any number from said second set of numbers.

16. A safety closure as defined in claim 15 in which said first set of numbers is the integers one through thirty-one, said integers representing the days of any month.

17. A safety closure as defined in claim 16 in which said first set of numbers is a particular color and said second set of numbers is another color.

18. A safety closure as defined in claim 16 in which each number in said second set of numbers is positioned within a rectangular, window-like marking on said strap.

19. A safety closure as defined in claim 16 in which said first set of numbers positioned relative to the second set of numbers so that the plane defined by the entire group of said first set is above the plane defined by the entire group of said second set so that when any number from said first set is aligned with any number from said second set, the number from the first set appears above the number from the second set.

20. A safety closure as defined in claim 16 in which said first set of numbers is positioned relative to the second set of numbers so that the plane defined by the entire group of said first set is below the plane defined by the entire group of said second set so that when any number from said first set is aligned with any number from said second set, the number from the first set appears below the number from the second set.

21. A safety closure as defined in claims 12, 13, 14, 15, 16, 17, 18, 19, or 20, further comprising an annular protrusion projecting from the surface of the underside of said top, said protrusion having a diameter slightly less than the inside diameter of said rim so that said protrusion closely abuts said rim when said cap is securely closed on said container.

22. A safety closure as defined in claims 12, 13, 14, 15, 16, 17, 18, 19, or 20, further comprising an outwardly directed bead on the outer side of said ring.

23. A safety closure as defined in claims 12, 13, 14, 15, 16, 17, 18, 19, or 20, further comprising:

an annular protrusion projecting from the surface of the underside of said top, said protrusion having a diameter slightly less than the inside diameter of said rim so that said protrusion closely abuts said rim when said cap is securely closed on said containers; and an outwardly directed bead on the outer side of said ring.

24. A safety closure for a container having a rim defining an open mouth and a peripheral lip around the rim, said closure comprising:

a cap having a top overlying said mouth and said rim and having a depending annular flange projecting below said top, said flange having an inwardly directed circumferential bead engaged below said lip, and an outwardly directed circumferential bead located below said top and cooperating therewith to define a circumferential locking groove extending around the outer side of said flange;

a rotary safety ring having an annular sidewall surrounding said flange and overlying said locking groove and said outwardly directed circumferential bead, said annular sidewall being closely spaced to said locking groove and said outwardly directed circumferential bead so that said inwardly directed bead is held in engagement with said lip and prevents removal of said cap;

a plurality of angularly spaced fingers on the inner side of said sidewall projecting into said locking groove and overlying the bottom wall of said groove to prevent downward movement of said ring along said cap, said fingers being inclined inwardly and downwardly into said locking groove and having free inner ends positioned to be wedged against the bottom of the locking groove to prevent free flexing of the fingers as the ring is pulled downwardly relative to the cap, thereby normally preventing downward movement of said ring out of overlying relation with said locking groove;

a plurality of longitudinally extending release grooves in said outwardly directed circumferential bead, spaced and sized to permit movement of said fingers through said outwardly directed circumferential bead in one angular position of said ring about said cap, and thus allowing downward movement of said ring away from said cap for the removal of the latter from the container in said one angular position;

a sifter inserted in said mouth, said sifter lying below said top; and an outwardly directed bead on the outer side of said ring.

25. A safety closure for a container having a rim defining an open mouth and a peripheral lip around the rim, said closure comprising:

a cap having a top overlying said mouth and said rim and having a depending annular flange projecting below said top, said flange having an inwardly directed circumferential bead engaged below said lip, and an outwardly directed circumferential bead located below said top and cooperating therewith to define a circumferential locking groove extending around the outer side of said flange;

a rotary safety ring having an annular sidewall surrounding said flange and overlying said locking groove and said outwardly directed circumferential bead, said annular sidewall being closely spaced to said locking groove and said outwardly directed circumferential bead so that said inwardly directed bead is held in engagement with said lip and prevents removal of said cap;

a plurality of angularly spaced fingers on the inner side of said sidewall projecting into said locking groove and overlying the bottom wall of said groove to prevent downward movement of said ring along said cap, said fingers being inclined inwardly and downwardly into said locking groove and having free inner ends positioned to be wedged against the bottom of the locking groove to prevent free flexing of the fingers as the ring is pulled downwardly relative to the cap, thereby normally preventing downward movement of said ring out of overlying relation with said locking groove;

a plurality of longitudinally extending release grooves in said outwardly directed circumferential bead, spaced and sized to permit movement of said fingers through said outwardly directed circumferential bead in one angular position of said ring about said cap, and thus following downward movement of said ring away from said cap for the removal of the latter from the container in said one angular position;

a sifter inserted in said mouth, said sifter lying below said top; and means, located on said closure, for counting.

26. A safety closure for a container having a rim defining an open mouth and a peripheral lip around the rim, said closure comprising:

a cap having a top overlying said mouth and said rim and having a depending annular flange projecting below said top, said flange having an inwardly directed circumferential bead engaged below said lip, and an outwardly directed circumferential bead located below said top and cooperating therewith to define a circumferential locking groove extending around the outer side of said flange;

a rotary safety ring having an annular sidewall surrounding said flange and overlying said locking groove and said outwardly directed circumferential bead, said annular sidewall being closely spaced to said locking groove and said outwardly directed circumferential bead so that said inwardly directed bead is held in engagement with said lip and prevents removal of said cap;

a plurality of angularly spaced fingers on the inner side of said sidewall projecting into said locking groove and overlying the bottom wall of said groove to prevent downward movement of said ring along said cap, said fingers being inclined inwardly and downwardly into said locking groove and having free inner ends positioned to be wedged against the bottom of the locking groove to prevent free flexing of the fingers as the ring is pulled downwardly relative to the cap, thereby normally preventing downward movement of said ring out of overlying relation with said locking groove;

a plurality of longitudinally extending release grooves in said outwardly directed circumferential bead, spaced and sized to permit movement of said fingers through said outwardly directed circumferential bead in one angular position of said ring about said cap, and thus allowing downward movement of said ring away from said cap for the removal of the latter from the container in said one angular position;

a sifter inserted in said mouth, said sifter lying below said top;

an outwardly directed bead on the outer side of said ring; and means, located on said closure, for counting.

27. A safety closure as defined in claims 25 or 26 in which said means for counting comprises a set of numbers appearing around the outside of said sidewall of said rotary safety ring and a cylindrical strap having means for indicating a position on the strap, said strap overlying the outside of said sidewall on which the set of numbers appears, and said strap being capable of rotation around the safety ring so that any number appearing on the outside of said sidewall can be aligned with said means for indicating a position on the strap.

28. A safety closure as defined in claims 25 or 26 in which said means for counting comprises a first set of numbers appearing around the outside of said sidewall of said rotary safety ring and a cylindrical strap having a second set of numbers appearing on said strap, said strap overlying the outside of said sidewall on which the first set of numbers appears, and said strap being capable of rotation around the rotary safety ring so that any number from said first set of numbers can be aligned with any number from said second set of numbers.

29. A safety closure for a container having a rim defining an open mouth and a peripheral lip around the rim, said closure comprising:

a cap having a top overlying said mouth and said rim and having a depending annular flange projecting below said top, said flange having an inwardly directed circumferential bead engaged below said lip, and an outwardly directed circumferential bead located below said top and cooperating therewith to define a circumferential locking groove extending around the outer side of said flange;

a rotary safety ring having an annular sidewall surrounding said flange and overlying said locking groove and said outwardly directed circumferential bead, said annular sidewall being closely spaced to said locking groove and said outwardly directed circumferential bead so that said inwardly directed bead is held in engagement with said lip and prevents removal of said cap;

a plurality of angularly spaced fingers on the inner side of said sidewall projecting into said locking groove and overlying the bottom wall of said groove to prevent downward movement of said ring along said cap, said fingers being inclined inwardly and downwardly into said locking groove and having free inner ends positioned to be wedged against the bottom of the locking groove to prevent free flexing of the fingers as the ring is pulled downwardly relative to the cap, thereby normally preventing downward movement of said ring out of overlying relation with said locking groove;

a plurality of longitudinally extending release grooves in said outwardly directed circumferential bead, spaced and sized to permit movement of said fingers through said outwardly directed circumferential bead in one angular position of said ring about said cap, and thus allowing downward movement of said ring away from said cap for the removal of the latter from the container in said one angular position;

a means for drawing and holding fluid into a vessel, said means attached to said cap so that said vessel extends downwardly below said top and said means extends upwardly from said top; and an annular protrusion projecting from the surface of the underside of said top, said protrusion having a diameter slightly less than the inside diameter of said rim so that said protrusion closely abuts said rim when said cap is securely closed on said container.

30. A safety closure for a container having a rim defining an open mouth and a peripheral lip around the rim, said closure comprising:

a cap having a top overlying said mouth and said rim and having a depending annular flange projecting below said top, said flange having an inwardly directed circumferential bead engaged below said lip, and an outwardly directed circumferential bead located below said top and cooperating therewith to define a circumferential locking groove extending around the outer side of said flange;

a rotary safety ring having an annular sidewall surrounding said flange and overlying said locking groove and said outwardly directed circumferential bead, said annular sidewall being closely spaced to said locking groove and said outwardly directed circumferential bead so that said inwardly directed bead is held in engagement with said lip and prevents removal of said cap;

a plurality of angularly spaced fingers on the inner side of said sidewall projecting into said locking groove and overlying the bottom wall of said groove to prevent downward movement of said ring along said cap, said fingers being inclined inwardly and downwardly into said locking groove and having free inner ends positioned to be wedged against the bottom of the locking groove to prevent free flexing of the fingers as the ring is pulled downwardly relative to the cap, thereby normally preventing downward movement of said ring out of overlying relation with said locking groove;

a plurality of longitudinally extending release grooves in said outwardly directed circumferential bead, spaced and sized to permit movement of said fingers through said outwardly directed circumferential bead in one angular position of said ring about said cap, and thus allowing downward movement of said ring away from said cap for the removal of the latter from the container in said one angular position;

a means for drawing and holding fluid into a vessel, said means attached to said cap so that said vessel extends downwardly below said top and said means extends upwardly from said top; and an outwardly directed bead on the outer side of said ring.

31. A safety closure for a container having a rim defining an open mouth and a peripheral lip around the rim, said closure comprising:

a cap having a top overlying said mouth and said rim and having a depending annular flange projecting below said top, said flange having an inwardly directed circumferential bead engaged below said lip, and an outwardly directed circumferential bead located below said top and cooperating therewith to define a circumferential locking groove extending around the outer side of said flange;

a rotary safety ring having an annular sidewall surrounding said flange and overlying said locking groove and said outwardly directed circumferential bead, said annular sidewall being closely spaced to said locking groove and said outwardly directed circumferential bead so that said inwardly directed bead is held in engagement with said lip and prevents removal of said cap;

a plurality of angularly spaced fingers on the inner side of said sidewall projecting into said locking groove and overlying the bottom wall of said groove to prevent downward movement of said ring along said cap, said fingers being inclined inwardly and downwardly into said locking groove and having free inner ends positioned to be wedged against the bottom of the locking groove to prevent free flexing of the fingers as the ring is pulled downwardly relative to the cap, thereby normally preventing downward movement of said ring out of overlying relation with said locking groove;

a plurality of longitudinally extending release grooves in said outwardly directed circumferential bead, spaced and sized to permit movement of said fingers through said outwardly directed circumferential bead in one angular position of said ring about said cap, and thus allowing downward movement of said ring away from said cap for the removal of the latter from the container in said one angular position;

a means for drawing and holding fluid into a vessel, said means attached to said cap so that said vessel extends downwardly below said top and said means extends upwardly from said top; and means, located on said closure, for counting.

32. A safety closure as defined in claim 29, further comprising an outwardly directed bead on the outer side of said ring.

33. A safety closure as defined in claim 30, further comprising means, located on said closure, for counting.

34. A safety closure as defined in claim 29, further comprising means, located on said closure, for counting.

35. A safety closure as defined in claim 29, further comprising:

an outwardly directed bead on the outer side of said ring; and means, located on said closure, for counting.

36. A safety closure as defined in claims 31, 33, 34, or 35 in which said means for counting comprises a set of numbers appearing around the outside of said sidewall of said rotary safety ring and a cylindrical strap having means for indicating a position on the strap, said strap overlying the outside of said sidewall on which the set of numbers appears, and said strap being capable of rotation around the safety ring so that any number appearing on the outside of said sidewall can be aligned with said means for indicating a position on the strap.

37. A safety closure as defined in claims 31, 33, 34 or 35 in which said means for counting comprises a first set of numbers appearing around the outside of said sidewall of said rotary safety ring and a cylindrical strap having a second set of numbers appearing on said strap, said strap overlying the outside of said sidewall on which the first set of numbers appears, and said strap being capable of rotation around the rotary safety ring so that any number from said first set of numbers can be aligned with any number from said second set of numbers.

38. A safety closure as defined in claims 29, 30, 31, 32, 33, 34, or 35 in which said means for drawing and holding fluid into a vessel include a squeezable bulb extending through and attached to said top, said bulb having an opening at its bottom and having a portion extending downwardly below said top, and a pipette attached to said portion extending downwardly below said top.

39. A safety closure as defined in claims 31, 33, 34, or 35 in which said means for drawing and holding fluid into a vessel include a squeezable bulb extending through and attached to said top, said bulb having an opening at its bottom and having a portion extending downwardly below said top, and a pipette attached to said portion extending downwardly below said top; and in which said means for counting comprises a set of numbers appearing around the outside of said sidewall of said rotary safety ring and a cylindrical strap having means for indicating a position on the strap, said strap overlying the outside of said sidewall on which the set of numbers appears, and said strap being capable of rotation around the safety ring so that any number appearing on the outside of said sidewall can be aligned with said means for indicating a position on the strap.

40. A safety closure as defined in claims 31, 33, 34 or 35 in which said means for drawing and holding fluid into a vessel include a squeezable bulb extending through and attached to said top, said bulb having an opening at its bottom and having a portion extending downwardly below said top, and a pipette attached to said portion extending downwardly below said top and in which said means for counting comprises a first set of numbers appearing around the outside of said sidewall of said rotary safety ring and a cylindrical strap having a second set of numbers appearing on said strap, said strap overlying the outside of said sidewall on which the first set of numbers appears, and said strap being capable of rotation around the rotary safety ring so that any number from said first set of numbers can be aligned with any number from said second set of numbers.

* * * * *